United States Patent [19]

Morizot et al.

[11] 4,381,475

[45] Apr. 26, 1983

[54] VARIABLE COUPLING RESISTANCE DELAY LINE FOR CROSSED FIELD TUBE

[75] Inventors: Jean P. Morizot; Rene Gerber, both of Paris, France

[73] Assignee: Thomson - CSF, Paris, France

[21] Appl. No.: 200,483

[22] Filed: Oct. 24, 1980

[30] Foreign Application Priority Data

Oct. 13, 1979 [FR] France ..... 79 26886

[51] Int. Cl.[3] ..... H01J 25/34

[52] U.S. Cl. ..... 315/39.3; 315/3.6; 315/39.73

[58] Field of Search ..... 315/39.73, 39.3, 3.6, 315/3.5

[56] References Cited

U.S. PATENT DOCUMENTS

| | | | |
|---|---|---|---|
| 2,730,678 | 1/1956 | Dohler et al. | 315/39.73 X |
| 2,888,595 | 5/1959 | Warnecke et al. | 315/39.73 |
| 2,905,859 | 9/1959 | Osepchuk et al. | 315/39.73 |
| 2,956,204 | 10/1960 | Dohler et al. | 315/39.73 X |
| 3,046,443 | 7/1962 | Dench | 315/3.6 |
| 3,069,587 | 12/1962 | Dench | 315/39.73 X |
| 3,484,649 | 12/1969 | Farney | 315/3.6 |
| 4,087,718 | 5/1978 | Farney | 315/3.6 |

*Primary Examiner*—Saxfield Chatmon, Jr.
*Attorney, Agent, or Firm*—Roland Plottel

[57] ABSTRACT

The thickness of the fingers of the line is modified, while the pitch of the fingers is kept constant, so that the capacitance between two successive fingers varies substantially proportionally to the product $P_{HF} \times dI/dx$, in which $P_{HF}$ represents the microwave power at any point x in the line and dI/dx the gradient, as a function of the position x on the line, of the current I delivered by the voltage supply creating a continuous electrical field $E_o$ between the electrodes of the tube. The values of $P_{HF}$ and of I are measured on the tube having a constant coupling resistance or are calculated by a computer program.

8 Claims, 14 Drawing Figures

FIG_3-a
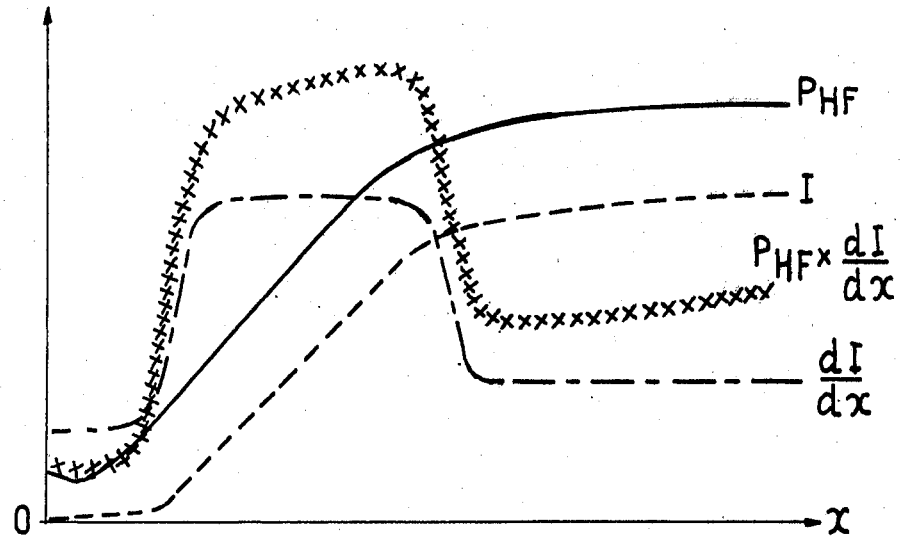
FIG_3-b
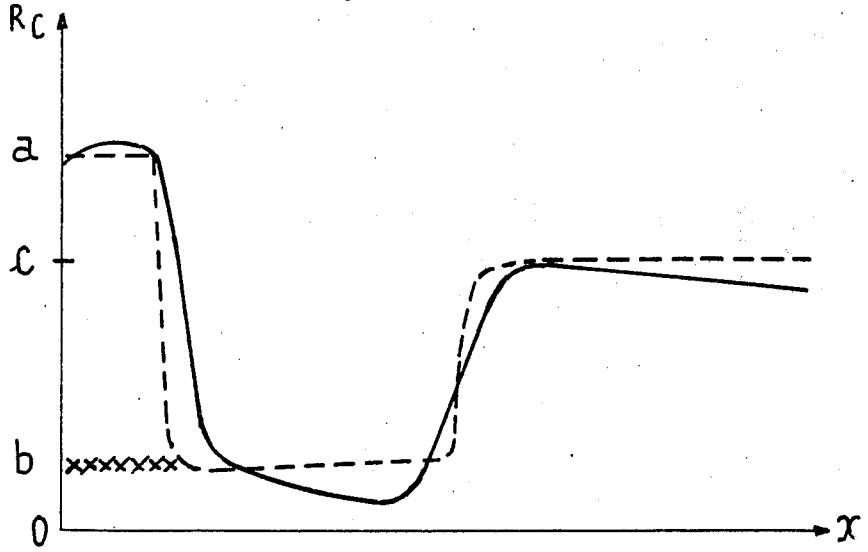

FIG_4 a
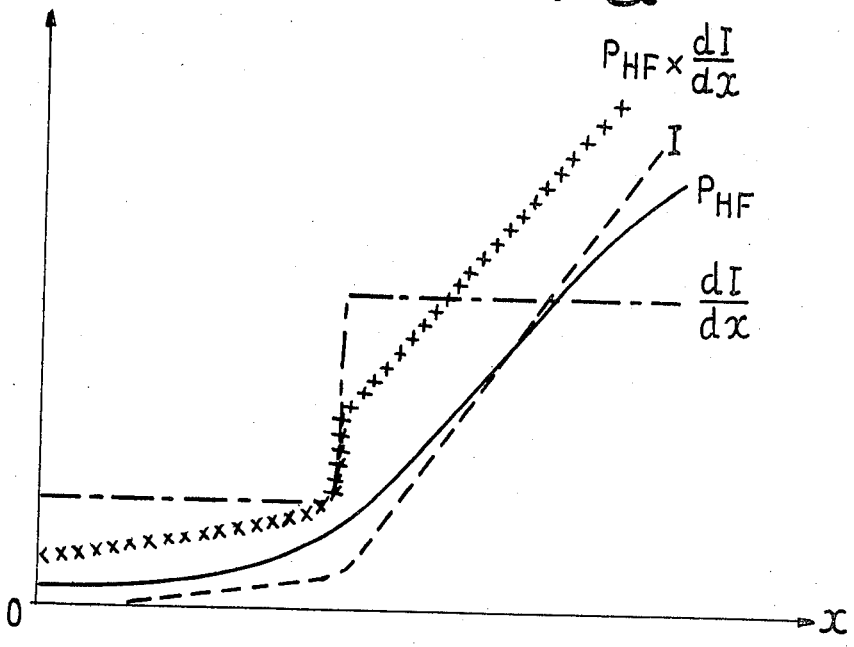
FIG_4-b
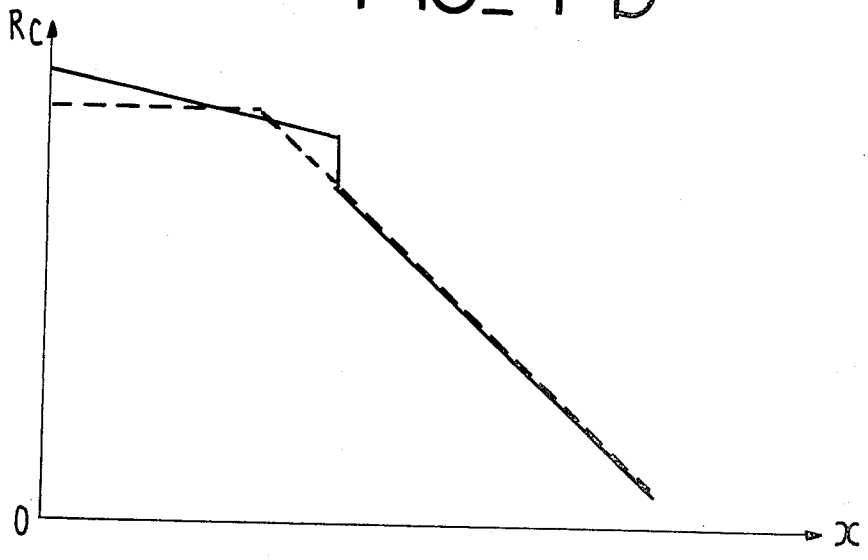

FIG_5-a
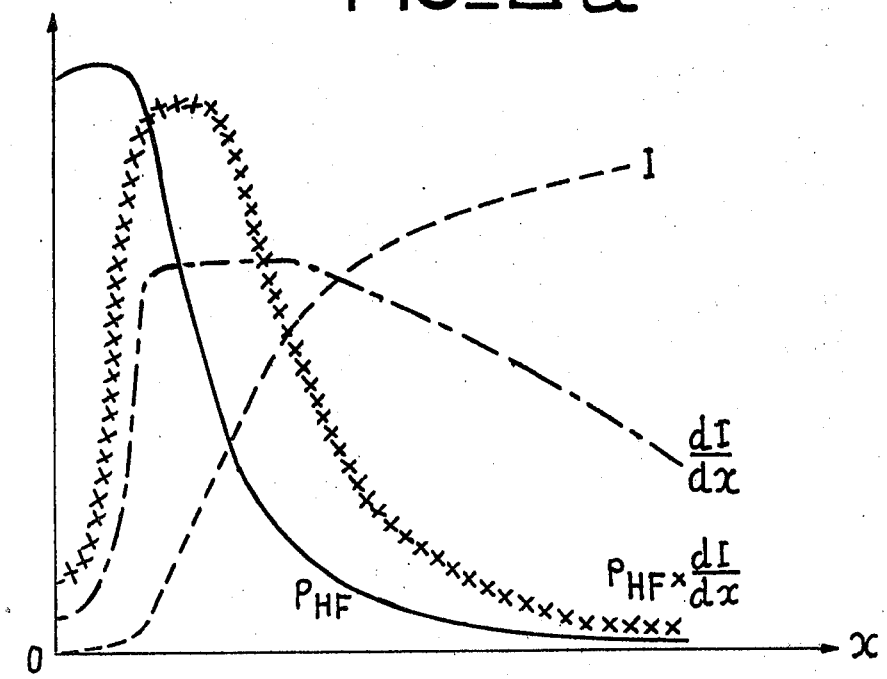
FIG_5-b
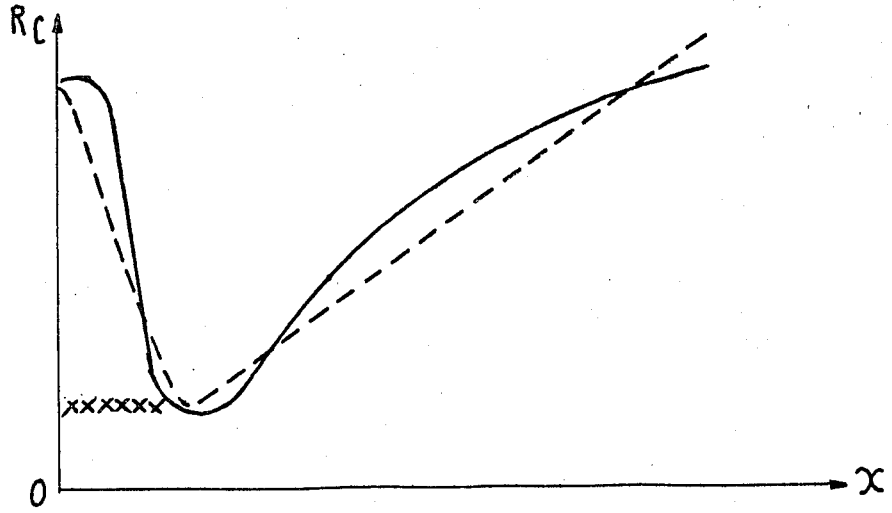

VARIABLE COUPLING RESISTANCE DELAY LINE FOR CROSSED FIELD TUBE

BACKGROUND OF THE INVENTION

The present invention relates to a variable coupling resistance delay line for a crossed field tube.

Crossed field tubes are essentially constituted by a vacuum enclosure containing two parallel electrodes between which there is a potential difference creating a continuous electrical field $E_o$. A magnetic field B is established in a direction perpendicular to the electrical field and to the tube axis, when the tube is linear and in a direction parallel to the tube axis and consequently perpendicular to the electrical field when the tube is cylindrical.

The positive electrode is constituted by a delay line, which generally has a periodic structure having a sequence of fingers facing the negative electrode and along which moves the microwave.

The negative electrode or sole can be non-emissive. In this case the tube incorporates an electron gun located at one end of the line and which produces an electron beam collected by a collector located at the other end of the line. This type of tube is called an injected beam tube.

The negative electrode can also be constituted by a cathode of the magnetron type. The cathode emission started by the high frequency electrical field extisting at the high frequency input of the tube is then amplified and maintained by the secondary emission phenomenon. This type of tube is called a distributed emission tube.

In the case of cylindrical distributed emission tubes the electron beam produced by the cathode generally returns on itself after crossing a degrouping space separating the input from the output of the high frequency wave. Such a tube is called a re-entrant beam tube.

A distinction is made between forward or backward wave crossed field tubes depending on whether the microwave travels in the direction of the electron beam in the delay line or in the reverse direction. The electron beam is always constituted by an electron layer located around the negative electrode and a number of space charge arms equal to the number of wavelengths delayed by the line. The space charge arms travel at a velocity $V_e$ equal to the phasse velocity $V_\phi$ of the microwave on the delay line. Most of the electrons of the arms fall on the line to which they transfer their potential energy, which ensures an amplification of the microwave signal.

Most crossed field tubes function as amplifiers, but there are also crossed field oscillators such as the carcinotron.

The carpitron is a carcinotron synchronized by a pilot means and is used as an amplifier. Carpitrons and carcinotrons are reverse wave, injected beam tubes.

The present invention relates to all types of crossed field tubes.

It is known from the prior art that the efficiency of crossed field tubes increases with the coupling resistance $R_c$ of the tube. The coupling resistance is written:

$$R_c=(E^2_{HFx})/(2\beta^2 \cdot P_{HF}),$$

with $E_{HF\,x}$, the amplitude of the microwave field level with the line and parallel thereto;

$\beta$, the propagation constant equal to $2\pi/\lambda_r$, in which $\lambda_r$ represents the delayed wavelength;

and $P_{HF}$ the microwave power at any point x of the line.

It is the microwave field which acts on the electrons. Consequently the coupling resistance determines the action on the beam of the microwave field of the line. The coupling resistance varies in the opposite sense to the capacitance between two successive fingers of the line. Thus, if the interdigital capacitance increases, the microwave energy stored between the fingers of the line increases and the action on the beam of the microwave field of the line and consequently the coupling resistance decrease. Thus, the dimensions of the line fingers must be reduced for reducing the interdigital capacitance and increasing the coupling resistance.

The problem which arises is that the thermal conductivity is reduced on reducing the dimensions of the fingers, which can be dangerous due to the electron bombardment.

French Pat. No. 1 150 045 relates to a crossed field tube with an injected beam and backward wave functioning as an oscillator, i.e. a carcinotron. In this carcinotron action takes place on the height of the fingers which is their dimension in a direction perpendicular to the electrodes in order to make the coupling resistance low level with the electron gun where a large amount of heat has to be dissipated due to the electron bombardment on the line. The coupling resistance is then increased in a linear manner by moving away from the electron gun.

BRIEF SUMMARY OF THE INVENTION

The present invention relates to a variable coupling resistance delay line for a crossed field tube, whose capacitance varies between two successive fingers by modifying the structure of the fingers substantially in proportional manner to the product $P_{HF}\times(dI/dx)$, in which $P_{HF}$ represents the microwave power at any point x of the line and in which dI/dx represents the current gradient delivered by the voltage supply creating the continuous electrical field $E_o$ between the two electrodes of the tube as a function of the position x on the line. The values of $P_{HF}$ and of I are measured on the tube which incorporates a constant coupling resistance or calculated by a computer programme. Moreover the structure of the complete line ensures the synchronism of the microwave which traverses it and of the electron beam which travels between the negative electrode and the line.

The present invention differs from the prior art, because contrary to what has been hitherto accepted it has been found that the efficiency of crossed field tubes does not increase in a continuous manner with the coupling resistance $R_c$ of the tube. An optimum efficiency is obtained, according to the invention, for all types of crossed field tubes, if the coupling resistance $R_c$ is increased only at those points on the delay line which are subject to the minimum action from the electron bombardment standpoint (a gradient dI/dx is involved) and the standpoint of the microwave power produced $P_{HF}$.

The present invention also differs from French Pat. No. 1 150 045 which relates to a carcinotron with a variable coupling resistance in which the latter increases in linear form as from its value level with the electron gun. In a carcinotron according to the invention the coupling resistance varies in accordance with P·(dI/dx) and does not increase in linear manner on moving away from the level of the electron gun on the line.

The delay lines according to the invention make it possible to bring about a 5 to 10% improvement in the efficiency of crossed field tubes. In the case of a 500 W carpitron operating at 12 GHz the efficiency increases from 38 to 47%. Thus, it is possible to increase the microwave output power of the tubes for the same input characteristics.

Compared with the prior art the lines according to the invention have fewer thermal dissipation problems, because no attempt is now made to increase the coupling resistance of the tube to a maximum at all points along the line.

BRIEF DESCRIPTION OF THE DRAWINGS

The invention is described in greater detail hereinafter relative to non-limitative embodiments and the attached drawings, wherein show:

FIGS. 3*a*, 3*b*, 4*a* and 4*b* and 5*a* and 5*b*—for different tubes, the variations as a function of the position x on the line of microwave power $P_{HF}$, the current I, gradient dI/dx, the product P·(dI/dx) and the coupling resistance $R_c$.

DETAILED DESCRIPTION OF THE PREFERRED EMBODIMENTS

Figure 1:
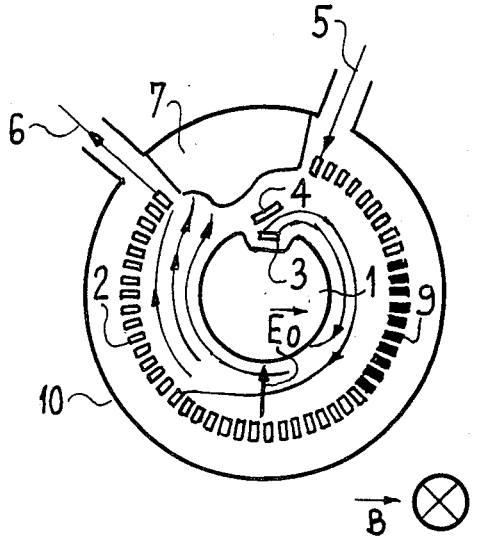
FIGS. 1 and 2—cross sectional views of two examples of crossed field tubes to which the invention is applied.
Figure 2:
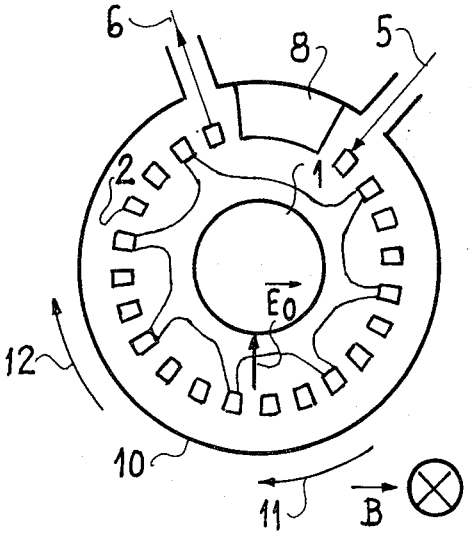

FIGS. 1 and 2 are sectional views of two examples of crossed field tubes to which the present invention applies.

Both the tubes shown are cylindrical having two parallel electrodes 1 and 2 in a vacuum enclosure 10. A not shown direct current voltage source establishes an electrical field $E_o$ between these electrodes. The positive electrode 2 is constituted by a delay line having a periodic structure having a sequence of fingers with a constant pitch and which face the negative electrode. The distance between the fingers and the negative electrode is also constant, which ensures the synchronism of the microwave and the beam.

The tubes shown in FIGS. 1 and 2 are amplifiers. Two connections 5 and 6 are provided on the delay line for the entry and exit of the microwave. In both cases a magnetic field B is established in a plane perpendicular to the drawings.

The tube shown in FIG. 1 is an injected beam tube in which the electron beam is symbolized by curved arrows and is created by an electron gun comprising an anode 4 and a cathode 3. This electron beam is collected by a collector 7. The microwave input faces the electron gun and the microwave output is before the collector. Thus, the microwave travels in the direction of the electron beam. The tube shown in FIG. 1 is consequently an injected beam, forward wave amplifier. Part of the delay line has an attenuation means 9 for preventing oscillation.

The tube shown in FIG. 2 is an amplifier with electronic emission distributed by a cathode 1 and whose space charge arms are shown by fine lines on the drawing. This is a forward wave tube because the electron beam turns in the same direction indicated by an arrow 11 as the microwave indicated by arrow 12. This tube has a reentrant beam and a degrouping space 8 separates the microwave output from the microwave input.

If $V_o$ is the voltage between the anode and the cathode produced by the d.c. voltage source and I is the total current delivered by said source, the power $P_o$ delivered by the voltage source is partly transformed into microwave power:

$$P_o = V_o \cdot I = P_{HF} + \text{losses}$$

Thus, the efficiency of the crossed field tube is written:

$$\gamma = P_{HF}/(P_{HF} + \text{losses})$$

The microwave power at any point x of the line is equal to the power created by interaction of the beam and the wave, reduced by the power lost by attenuation in the line, i.e. by the Joule effect;

$$P_{HF} = \text{P interaction} - \text{P Joule effect.}$$

The power created by interaction, $P_{interaction}$, being proportional to the coupling resistance $R_c$ and the power lost by Joule effect not being dependent on the coupling resistance, it is possible, as a first approximation and as was done in the prior art, to estimate that the microwave power and consequently the efficiency increases on increasing $R_c$.

On examining the content of the losses, it is found that they result from numerous factors including, apart from the losses by the Joule effect, kinetic losses due to the electron drop on the line, the kinetic losses on the negative electrode and the kinetic losses on the collector in the case of non-reentrant beam tubes.

On considering only the kinetic losses due to the electron drop on the line, it is known from the theory of Feinstein-Kino, developed in the work by E. Okress entitled "Crossed-field microwave devices," that these losses are written for each electron: $\frac{1}{2}mV^2$, in which m is the mass of the electron and V its velocity level with the line. This velocity V is a vector of components $V_x$ and $V_y$ which is written:

$$V_x = (-E_o + E_{HFy})/B \text{ and } V_y = (-E_{HFx})/B,$$

in which $E_{HF\,x}$ and $E_{HF\,y}$ are the components of the microwave field produced.

Thus, these kinetic losses are increased if the components $E_{HF\,x}$ and $E_{HF\,y}$ increase, i.e. if the coupling resistance increases.

Thus, when the coupling resistance increases the microwave power and the kinetic losses due to the electron drop on the line increase simultaneously.

The efficiency is therefore a function of the coupling resistance, but is not necessarily an increasing function. In conclusion it can be stated that it is not desirable to increase the coupling resistance at all points on the line, as was believed in the prior art.

A study has been made of the overall efficiency of the tubes, taking account of all the factors by performing calculations on a computer. The calculations show that an optimum efficiency of the tube is obtained if the coupling resistance varies in an inversely proportional manner to the product $P_{HF} \times (dI/dx)$, in which dI/dx represents the total current gradient delivered by the voltage supply creating the field $E_o$ as a function of the position x on the line, the values of $P_{HF}$ and I are measured on a tube having a constant coupling resistance or calculated by computer programme.

The values of $P_{HF}$ and I as a function of x are in preference calculated by computer programme.

It is also possible to measure them on a tube having a constant coupling resistance by using sondes to obtain $P_{HF}$ and I at several points x of the line; to obtain I it is generally the heating up of the line due to the electron bombardment which is measured by sondes.

To obtain sereral values of $P_{HF}$ as a function of x, it is also possible to build several tubes comprising constant couplage resistance lines, these lines having different lengths and the microwave power being measured at one end of the line.

FIGS. 3*a* and *b*, 4*a* and *b*, and 5*a* and *b* respectively relate to injected beam, forward wave amplifiers, forward wave, distributed emission amplifiers and finally backward wave, distributed emission amplifiers, as well as carpitrons.

FIGS. 3*a*, 4*a* and 5*a* show as a function of position x on the line variations in the microwave power created on the line, $P_{HF}$, in a form of a continuous line, variations in the total current I delivered by the voltage supply creating the field $E_o$ between the electrodes in the form of a broken line, the gradient dI/dx in the form of an alternating line and $P_{HF}$·(dI/dx) by a succession of crosses. In the different drawings the abscissa x is counted positively by following the movement of the electrons. Thus, the abscissa point 0 corresponds to the microwave input in the case of forward wave tubes (FIGS. 3 and 4) and the microwave output in the case of backward wave tubes (FIG. 5).

FIGS. 3*b*, 4*b* and 5*b* show in the form of a continuous line the variations in the coupling resistance $R_c$ according to the invention. Thus, the coupling resistance varies in an inversely proportional manner to the product $P_{HF}$·(dI/dx) represented in FIGS. 3*a*, 4*a* and 5*a*.

FIGS. 3*b*, 4*b* and 5*b* also show in the form of a broken line a simplified curve of the coupling resistance adopted on the basis of the theoretical curve. The more geometrical simplified curve makes it possible to facilitate the machining of the line.

In FIG. 3*b* the coupling resistance (simplified curve) varies in a discontinuous manner and assumes three separate values. The highest value of the coupling resistance a corresponds to the start of the delay line, i.e. to the part of the line which is close to the electron gun which injects the beam and where the microwave enters. The lowest value b of the coupling resistance corresponds to the intermediate part of the delay line and the intermediate value c corresponds to the end of the line, i.e. that part of the line which is close to the tube collector and the microwave output.

FIG. 3*b* also shows by means of a succession of crosses the modification which can be made to the coupling resistance at the start of the delay line. It is a question of giving the value b to the coupling resistance at the start of the delay line. Thus, the coupling resistance only assumes two separate values b and c. This modification of the coupling resistance and consequently this modification of the dimensions of the fingers has the advantage of enabling the line to resist accidental electron bombardments during the setting or control of the tube.

In FIG. 4*b* the coupling resistance (simplified curve) has a constant value at the start of the line, i.e. on that portion of the line where the microwave enters. The coupling resistance value then decreases from this constant value on the remainder of the line.

In FIG. 5*b* the coupling resistance (simplified curve) decreases on that portion of the line where the microwave leaves and then increases on the remainder of the line.

FIG. 5*b* shows by means of a succession of crosses the modification which can be made to the coupling resistance (simplified curve). As in the case of FIG. 3*b* it is a question of reducing the coupling resistance for low values of the abscissa x. The coupling resistance then has a constant value for the low values of x and then increases.

The changes shown in FIGS. 3*b* and 5*b* by a succession of crosses also have the advantage of simplifying the configuration of the coupling resistance as a function of x.

Such curves giving $R_c$ as a function of x can obviously be plotted for all types of crossed field tubes. The desired variations of the coupling resistance are obtained by subjecting the interdigital capacitance to a reverse variation by modifying the structure of the fingers. The complete line structure must ensure the synchronism of the microwave and of the electron beam.

In the lines according to the invention the pitch of the fingers p is generally kept constant. In the same way the distance between the line and the negative electrode is constant.

It is advantageous to modify the digital capacitance by varying the thickness e of the fingers, i.e. their size in the displacement direction of the electron beam.

FIGS. 6 to 11 show different types of lines with variable interdigital capacitance. In exemplified manner they show line segments, in which the thickness of the fingers varies in constant steps. The lines are respectively in the form of: a ladder, interdigital, meandering, a ladder line in which each fingers rests on two metal supports 17 which are fixed to the top of the line, a helical line with feet 14 connected to earth, and finally a valve line. The valve line is shown from French patent application 76 08 000 published under no. 2 305 014.

Obviously it is also possible to modify the interdigital capacitance by acting on the height of the fingers, i.e. their size in a direction perpendicular to the electrodes of the tube. In the case of the line shown in FIG. 9 it is possible to vary the interdigital capacitance by modifying the distance s between the supports 13. In the case of the valve line of FIG. 11 it is possible to make holes in the fingers to modify the interdigital capacitance.

Figure 6:
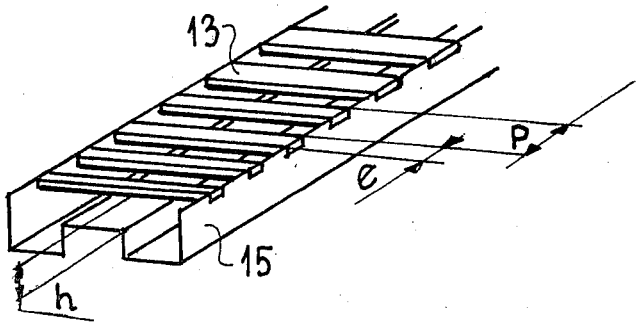
FIGS. 6–11—different types of delay lines with variable interdigital capacitances.
Figure 7:
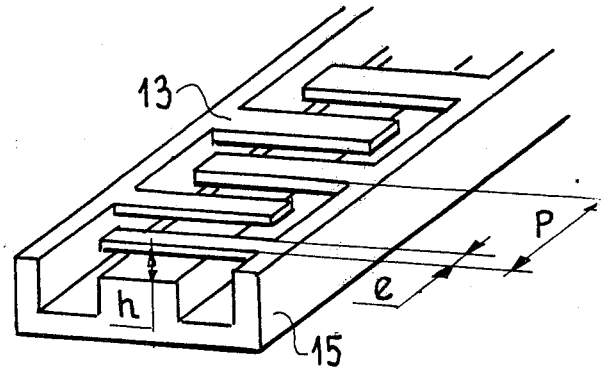
Figure 8:
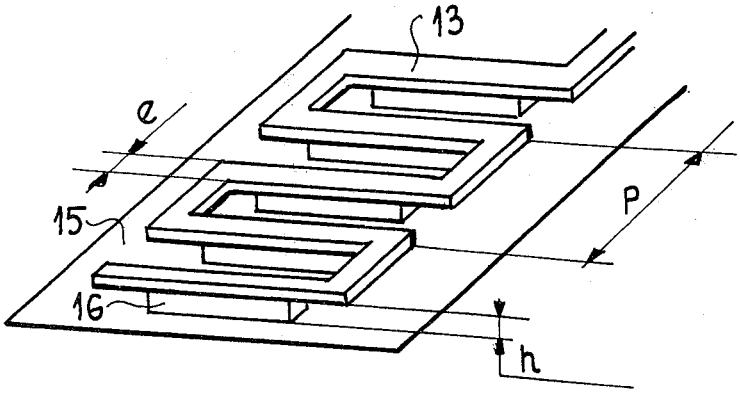
Figure 9:
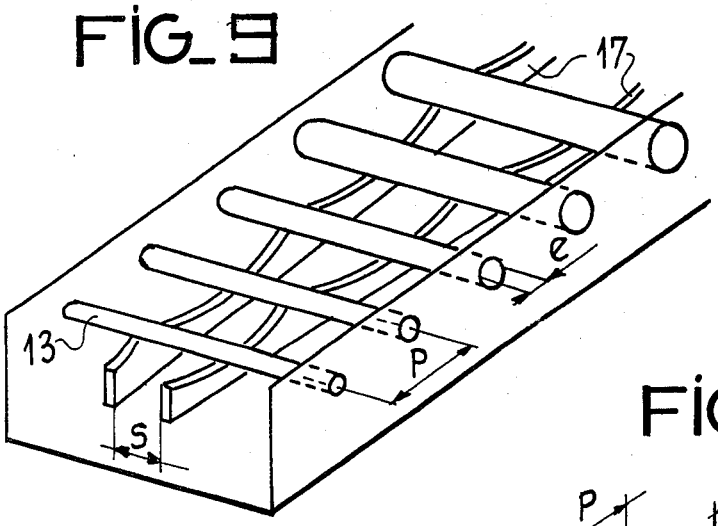

In the case of FIGS. 6 to 8 for ensuring the synchronism of the wave and the beam it is necessary to vary the distance h between the fingers and the top 15 of the lines in the reverse direction. In FIG. 8 in the case of the meandering line this distance h is determined by the thickness of a dielectric 16. For these lines for the delay constant to stay unchanged it is necessary for the ratio $\gamma_1/\gamma_0$ to vary in a clearly defined manner along the line, $\gamma_1$ being the interdigital capacitance and $\gamma_0$ the finger-top capacitance.

Figure 10:
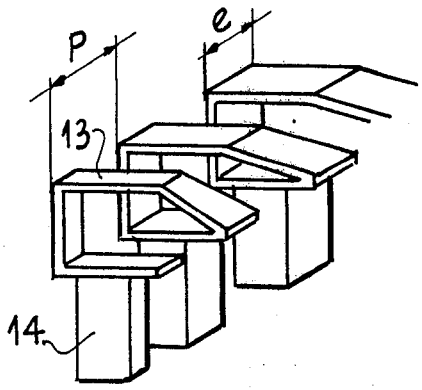

In the case of helical lines with a foot connected to earth, like that shown in FIG. 10, the delay constant remains unchanged, provided that the ratio $\gamma_1/\gamma_2$ varies in a clearly defined manner, $\gamma_2$ being the capacitance between the two feet 14 of the helix. $\gamma_2$ can then be modified by changing the dimensions and the shape of the feet.

Figure 11:
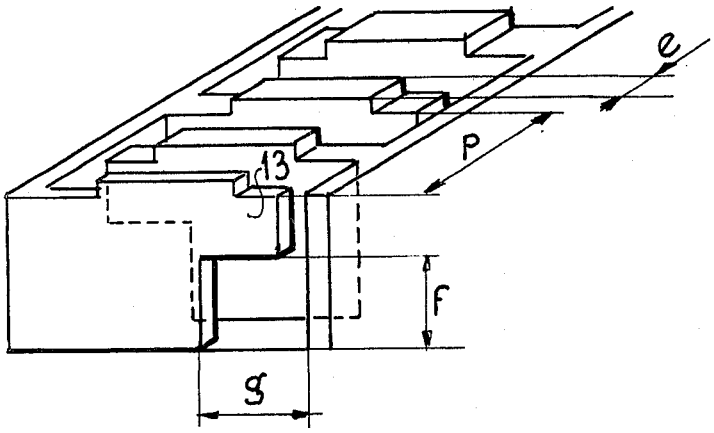

In the case of a valve line, like that shown in FIG. 11 it is possible to act on the dimensions f and g of the rectangular opening at the bottom of the valves in order to maintain the delay constant unchanged.

All the structural modifications of the fingers which bring about a modification in the interdigital capacitance and which are associated with an overall structure of the line, such that the microwave is synchronized with the beam fall within the scope of the present invention.

French patent application No. 77 13 695, published as no. 2 350 683 discloses crossed field tubes, whose efficiency is increased by varying the pitch of the fingers and therefore the delay constant. Thus, the cathode-line spacing is modified so that synchronism exists between the wave and the beam. On the same line it is possible to vary the coupling resistance according to the invention and vary the pitch of the fingers (or any other known modification serving to increase the efficiency) from the time when the synchronism between the wave and the beam is preserved.

What is claimed is:

1. A variable coupling resistance delay line for a crossed field tube, said tube having two parallel electrodes one a positive and the other a negative electrode and between which there is a continuous electrical field $E_o$, the positive electrode being constituted by a delay line incorporating a sequence of fingers facing the negative electrode, the structure of the delay line ensuring the synchronism of the microwave travelling through it and of an electron beam moving between the negative electrode and the delay line and the pitch of the fingers and their distance from the negative electrode being constant, wherein there is between two successive fingers an interdigital which varies, by modifying the structure of the fingers, substantially porportionally to the product $P_{HF} \times (dI/dx)$ in which $P_{HF}$ prepresents the microwave power at the point x on the line and in which dI/dx represents the current gradient delivered by the voltage supply creating the field $E_o$ as a function of the position x on the line, $P_{HF}$ and I being measured on the tube having a constant coupling resistance or calculated by a computer programme, the variation in the interdigital capacitance bringing about an inverse variation of the coupling resistance.

2. A line according to claim 1, wherein the variation of the interdigital capacitance is obtained by modifying the thickness of the fingers.

3. A line according to claim 1, wherein the delay line is constituted by a ladder, each fingers resting on two metal supports fixed on the top of the line, the interdigital capacitance being modified by modifying the distance between the supports.

4. A line according to claim 1, for an injected beam, foward wave amplifier crossed field tube, wherein the interdigital capacitance varies in a discontinuous manner and assumes three separate values, the lower value of the interdigital capacitance corresponding to the start of the line, i.e. that part of the line close to the electron gun which injects the electron beam, the highest value of the interdigital capacitance corresponding to the intermediate part of the delay line and the intermediate value of the interdigital capacitance corresponding to the end of the delay line, i.e. the portion thereof close to the tube collector.

5. A line according to claim 1, for an injected beam, forward wave amplifier crossed field tube, wherein the interdigital capacitance varies in a discontinuous manner and assumes two separate values, the highest value of the interdigital capacitance corresponding to the start of the line, i.e. that part of the line which is close to the electron gun which injects the electron beam and the lowest value of the interdigital capacitance corresponding to the end of the line.

6. A line according to claim 1, for a distributed emission, forward wave amplifier crossed field tube, wherein the interdigital capacitance has a constant value at the start of the line, i.e. on that part of the line where the microwave enters, then increases from this constant value over the remainder of the line.

7. A line according to claim 1, for a distributed emission, backward wave amplifier crossed field tube of a carpitron, the interdigital capacitance increases over that part of the line on which the microwave leaves, then decreases over the remainder of the line.

8. A line according to claim 1, for a carpitron, wherein the interdigital capacitance has a constant value on that part of the line on which the microwave leaves, then decreases over the remainder of the line.

* * * * *